US012486725B2

(12) United States Patent
Falahati et al.

(10) Patent No.: US 12,486,725 B2
(45) Date of Patent: Dec. 2, 2025

(54) VIBRATION ABSORBER APPARATUS AND METHODS OF USE

(71) Applicant: PHOENIX TECHNOLOGY SERVICES INC., Rocky View (CA)

(72) Inventors: Farjad Falahati, Calgary (CA); Andres Felipe Cordoba, Calgary (CA); Craig Brown, Calgary (CA)

(73) Assignee: PHOENIX TECHNOLOGY SERVICES INC., Rocky View (CA)

( * ) Notice: Subject to any disclaimer, the term of this patent is extended or adjusted under 35 U.S.C. 154(b) by 458 days.

(21) Appl. No.: 18/058,378

(22) Filed: Nov. 23, 2022

(65) Prior Publication Data

US 2023/0160267 A1 May 25, 2023

Related U.S. Application Data

(60) Provisional application No. 63/282,854, filed on Nov. 24, 2021.

(51) Int. Cl.

| | |
|---|---|
| ***E21B 17/07*** | (2006.01) |
| ***E21B 47/017*** | (2012.01) |
| ***E21B 47/18*** | (2012.01) |

(52) U.S. Cl.

CPC ..... *E21B 17/07* (2013.01); *E21B 47/017* (2020.05); *E21B 47/18* (2013.01)

(58) Field of Classification Search

CPC ..... E21B 47/013; E21B 47/01; E21B 47/017; E21B 17/07; E21B 47/18

See application file for complete search history.

(56) References Cited

U.S. PATENT DOCUMENTS

| | | | | |
|---|---|---|---|---|
| 3,714,831 | A * | 2/1973 | Quichaud | F16F 3/0873 73/431 |
| 9,605,535 | B2 * | 3/2017 | Logan | E21B 7/04 |
| 10,982,492 | B1 * | 4/2021 | Gopalan | E21B 17/07 |
| 2001/0052428 | A1 * | 12/2001 | Larronde | E21B 7/067 175/73 |
| 2007/0247329 | A1 * | 10/2007 | Petrovic | F16L 15/08 340/854.4 |
| 2018/0100357 | A1 * | 4/2018 | Christopher | E21B 17/028 |
| 2019/0212393 | A1 * | 7/2019 | Pare | G01R 31/378 |
| 2021/0215038 | A1 * | 7/2021 | Schaeffer | E21B 47/24 |
| 2022/0372869 | A1 * | 11/2022 | Richards | E21B 44/005 |

* cited by examiner

*Primary Examiner* — Brad Harcourt

(74) *Attorney, Agent, or Firm* — Holzer Patel Drennan

(57) ABSTRACT

An apparatus and method of use for dampening shock and vibration imparted on a unified (e.g., single) and/or dual telemetry measurement-while-drilling (MWD) assembly by a drilling system during the drilling of a wellbore in a subterranean formation is provided. The apparatus may be configured to be threadably engaged and housed within the drilling system, wherein the apparatus reciprocates axially with the MWD assembly, dampening axial and torsional shock and vibration imparted on the assembly, while maintain mud-pulse and electromagnetic signals transmitted by the assembly.

19 Claims, 7 Drawing Sheets

VIBRATION ABSORBER APPARATUS AND METHODS OF USE

CROSS-REFERENCE TO RELATED APPLICATION

This application claims benefit of priority to U.S. Provisional Patent Application No. 63/282,854 entitled "Improved Vibration Absorber and Methods of Use" and filed Nov. 24, 2021, which is specifically incorporated by reference herein for all that it discloses or teaches.

FIELD

Embodiments herein are generally related to an improved apparatus and methods of use for dampening shock and vibration on downhole equipment that occurs during the drilling of subterranean wellbores in the oil and gas industry, and particularly on measurement-while-drilling (MWD) equipment positioned within the drill string. More specifically, an improved apparatus and methods of use for isolating dual and/or unified (e.g., single) telemetry MWD tools from shock and vibration are provided.

BACKGROUND

The recovery of subterranean materials such as oil and gas typically requires drilling wellbores a great distance beneath the earth's surface towards a repository of the material, referred to as a "formation". In addition to drilling equipment situated at the surface, a drill string extends into the formation and includes a drill bit for drilling the wellbore. The drill string also includes equipment for collecting information about the downhole environment including, for example, characteristics about the formation, data relating to the size, depth, inclination and/or direction of the wellbore, and information about the drilling process (e.g., temperature, speed, and fluid pressure).

The collection of information relating to the downhole environment, referred to as "logging", can be performed during drilling using several different techniques. By collecting and processing data during the drilling process, the driller can make modifications or corrections to the process, as necessary. For example, some techniques allow for the concurrent drilling of the well and measuring of downhole conditions, referred to as measurement-while-drilling (MWD) or logging-while-drilling (LWD). Such techniques commonly use sensors located in a nonmagnetic drill collar at the lower end of the drill string as part of the bottom hole assembly (BHA), and as close to the drill bit as possible. While drilling is in progress, the sensors continuously or intermittently monitor and log drilling parameters and formation data that can then be transmitted to a surface detector/receiver using some form of telemetry.

Several techniques have been employed using MWD systems to transmit measurement data to the surface, including telemetry techniques that do not require the use of a wireline tool. One such technique involves transmitting data using pressure pulses in drilling fluids such as drilling mud, referred to as mud-pulse (MP) telemetry. Mud-pulse telemetry involves creating pressure signals in the drilling mud that is being circulated under pressure through the drill string during the drilling process. Information that is collected by downhole sensors is transmitted using a particular time division scheme to effectively create a waveform of pressure pulses in the mud column. The information may then be received and decoded by a pressure transducer and analyzed by a computer at a receiver on the surface.

In a mud-pulse system, the pressure in the drilling mud is typically modulated via operation of a valve and control mechanism, referred to as a 'mud-pulser' or a 'pulser'. Mud-pressure pulses can be generated by opening and closing the valve to momentarily constrict and relax the mud flow. The pulser is typically mounted in a specially adapted drill collar positioned above the drill bit and the generated pressure pulse travels up the mud column inside the drill string at the velocity of sound in the mud.

For example, in many known MWD tools, a "negative" pressure pulse is created in the fluid by temporarily opening a valve in the drill collar so that some of the drilling fluid will bypass the drill bit, the open valve allowing direct communication between the high pressure fluid inside the drill string and the fluid at lower pressure returning to the surface via the exterior of the string (i.e., through the annulus formed between the outer diameter of the drill string and the inner diameter of the wellbore). Alternatively, a "positive" pressure pulse can be created by temporarily restricting the downward flow of drilling fluid within the drill string by particularly blocking the fluid path in the drill string. In this manner, the data transmission rate is dependent on the type of drilling fluid used, volumetric flow rates, encoding method, among other factors, with the actual rate of data transmission being relatively slow and impacted by pulse spreading, distortion, attenuation, modulation rate limitations, as well as other disruptive forces such as ambient noise in the transmission channel.

Another telemetry technique involves the use of electromagnetic radiation (EM), which is also called current loop (CL) modulation, to transmit data from downhole locations to the surface (and vice-versa). In EM telemetry systems, a current may be induced on the drill string from a downhole transmitter and an electrical potential may be impressed across an insulated gap in a downhole portion of the drill string to generate an electric current that will propagate through the earth formation (i.e., the downhole transmitter creates a low frequency EM wave in the formation adjacent to the well, such waves being detected at the surface). Information that is collected by downhole sensors is transmitted from the downhole location by modulating the current or voltage signal and is detected and analyzed by a computer at surface. Although the drill string acts as part of the conductive path, EM systems can be impacted by distortion or signal dampening due, without limitation, to geologic formations.

Depending upon the drilling parameters, drillers may also use an MWD system that combines both MP and EM telemetry capabilities, such tools referred to as dual-telemetry MWD.

Many factors relating to the drilling process can impact the performance of known MWD systems, including damage from vibrations and shocks generated during drilling operations. For example, penetrating a drill bit into subterranean formations (and particularly hard rock) can cause significant vibration and/or shock to the drill string rotating the bit and any downhole componentry connected thereto. Increasing rates of penetration (ROP) and ever extending depth and reach of directional wellbores has resulted in MWD systems being impacted not only by vibrational/shock loads applied along the long axis of the drill string (i.e., axial vibration), but also lateral loads (e.g., drill string bend) and/or torsional/rotational loads (e.g., stick/slip). Such shock and vibrations not only have the potential to damage or cause the failure of downhole componentry, but they can also negatively impact the ability of MWD systems to collect and log accurate information.

There are many ways that drillers can attempt to minimize downhole shock and vibrations on the drill string. One mechanism is to incorporate a so-called "shock sub" into the drill string, which can serve to dampen or isolate shock and vibrations caused by the drill bit. Known shock subs, however, often need to be fine-tuned to particular drilling conditions (e.g., weight-on-bit, amplitude, and frequency of vibration, source of vibration, etc.), limiting their performance efficacy to only those sections of the wellbore meeting the particular conditions. Moreover, while shock subs can dampen vibrations on portions of the drill string uphole of the sub, they can also increase vibrations on the downhole portion of the string, including the drill bit.

Given that MWD systems are particularly vulnerable to drill string vibrations, some attempts to minimize downhole vibrations have targeted the MWD system specifically. In some cases, the MWD tools are mounted in ways that reduce the shock felt by the tools and, in other cases, specialized devices are used to protect the tools.

A common assembly meant for MP MWD tools is a universal bore hole orientation (UBHO) sub and a muleshoe sleeve, which fixes the MP MWD tool axially and rotationally within the drill collar. There are shock/vibration absorber designs for UBHO mounted MWD tools where the angular orientation of the MWD tool is maintained, while axial travel is allowed through an absorbing mechanism to dampen shock/vibration during drilling operations. These tools typically possess a stationary orifice on the muleshoe sleeve with the pulse quality being dependent on the distance between the mud pulse valve on the MWD tool and the fixed orifice. As such, the addition of an absorbing component (e.g., spring) can cause the distance between the orifice and the MWD tool valve to fluctuate, impacting the mud pulse signal quality (e.g., by adding a stroke to the MWD tool). Moreover, because the absorbing stroke can negatively impact the mud pulse, the stroke must be restricted within a small range, limiting the capabilities of such devices to reduce higher vibrations and shocks.

Other specialized devices, commonly used with EM MWD tools, which also are assembled to a UBHO assembly, serve to isolate parts of the MWD tool from axial vibrations, while being customized to maintain electrical connectivity through the MWD tool. These devices can use an extended connector cable configured to allow the MWD probe to move with the absorber stroke without losing electrical contact. Such devices, however, suffer from reliability issues where the electrical connection must be maintained within a sealed environment. Furthermore, these devices still have sections such as a UBHO assembly that is fixed to the collar and can suffer from shock and vibration.

Other specialized devices, referred to as 'snubbers', comprise silicone or elastomer-based elements that can be added to the drill string to protect MWD tools. Such devices, however, can often be too stiff and ultimately fail to provide any shock absorbing capability, or too soft and can be damaged prematurely, increasing the shock on the MWD when they reach maximum stroke range. Snubbers are also typically designed to isolate a section of the MWD tool and not the MWD tool as a whole.

As drilling operations reach for longer and deeper wellbores to achieve more difficult targets, they are faced with an increased dependency on dual telemetry systems that can provide both EM and MP signals. These dual telemetry MWD tools can be used for faster and more reliable drilling with EM telemetry when the formation permits the transfer of the electrical current and then, where not permitted, can be switched to use MP telemetry without needing to pull out the tool to replace the MWD tool.

Another consequence of drilling deeper and longer wellbores is the increased use of long lateral well profiles to maximize the drainage of hydrocarbons. In order to drill longer lateral wellbores, drillers are often required to use agitators or other friction reducing devices that can help to overcome drag forces (friction), but in doing, cause significant axial shock and vibrations to the BHA and affect the functionality of the MWD/LWD equipment.

There remains a need for an improved apparatus capable of absorbing extreme shocks and vibrations imposed upon MWD systems, and particularly dual telemetry MWD systems, while allowing for both MP and EM signal to be transferred.

SUMMARY

According to embodiments, an apparatus for dampening shock and vibration movement imparted on the MWD assembly by a drilling system are provided. The apparatus may be configured for incorporation into the drilling system, wherein the drilling system has a unified (e.g., single) or dual telemetry measurement-while-drilling (MWD) assembly. In some embodiments, the apparatus comprises a tubular housing forming a central housing bore, the central bore for housing the dual telemetry MWD assembly, at least one first movement dampening element positioned at or near the MWD assembly for dampening shock and vibration movement imparted axially on the MWD assembly, at least one annular ring positioned between the at least one movement dampening element and the MWD assembly for securely receiving and reciprocating axially with the MWD assembly and maintaining electrical contact of the EM signal, and at least one flow sleeve for slidably receiving and localizing the mud pulser and maintaining the mud pulse signal.

In some embodiments, the apparatus may comprise at least two first movement dampening elements and the at least one annular ring is positioned therebetween. In some embodiments, one of the at least two first movement dampening elements is positioned uphole of the MWD assembly and another one of the at least two movement dampening elements is positioned downhole of the MWD assembly. In some embodiments, the at least one first movement dampening element may comprise a spring.

In some embodiments, the apparatus may further comprise at least one secondary movement dampening element.

In some embodiments, the apparatus may further comprise at least one torsional absorber operably connected to the MWD assembly.

In some embodiments, the at least one annular ring of the apparatus may comprise a profile for correspondingly interfacing to and rotationally locking the MWD assembly with an inner surface of the tubular housing. In such embodiments, the profile may comprise a substantially polygonal cross-section.

In other embodiments, the at least one annular ring of the apparatus may comprise a profile for decoupling the MWD assembly from the inner surface of the tubular housing. In such embodiments, the outer surface of the at least one annular ring may comprise a substantially circular cross-section for decoupling the MWD assembly from the inner surface of the tubular housing.

The apparatus of claim 1, wherein the tubular housing comprises at least two tubulars. The apparatus of claim 10, wherein the at least two tubulars are operably connected to form at one electrical gap connection.

According to embodiments, a method of dampening shock and vibration movement imparted by a drilling system on a dual telemetry MWD assembly is provided, the drilling system used to drill a wellbore in a subterranean formation, the method comprising providing an apparatus configured for incorporation into the drilling system, the apparatus forming a tubular housing for receiving the MWD assembly, the apparatus configured for suspending the MWD assembly within the housing by at least one movement dampening element for dampening shock and vibration movement imparted axially on the MWD assembly, while maintaining the mud pulse signal and electrical contact of the EM signal, and running the apparatus into the subterranean formation with the drilling system to drill the wellbore.

In some embodiments, the methods may further comprise providing at least one torsional absorber for dampening shock and vibration movement imparted torsionally on the MWD assembly. In some embodiments, the torsional absorber may comprise a flex rod.

In some embodiments, the method may further comprise providing at least one secondary dampening element for enhancing dampening of axial shock and vibration movement.

In some embodiments, the method may further comprise providing a rotation lock for preventing or limiting rotation of the MWD assembly relative to the drilling system. In other embodiments, the method may further comprise rotationally decoupling the MWD assembly from the drill string while providing axial isolation.

In some embodiments, the methods may comprise operating the MWD assembly to transmit mud-pulse (MP) or electromagnetic (EM) telemetry information from the formation, or both mud-pulse (MP) and electromagnetic (EM) telemetry information from the formation, while isolated from shock and vibration.

BRIEF DESCRIPTION OF THE DRAWINGS

Various objects, features and advantages of the present apparatus will be apparatus from the following description of particular embodiments thereof, as illustrated in the accompanying drawings. The drawings are not necessarily to scale, emphasis instead being placed upon illustrating the principles of various embodiments of the apparatus. Similar reference numerals indicate similar components.

DETAILED DESCRIPTION OF THE PREFERRED EMBODIMENTS

Figure 1:
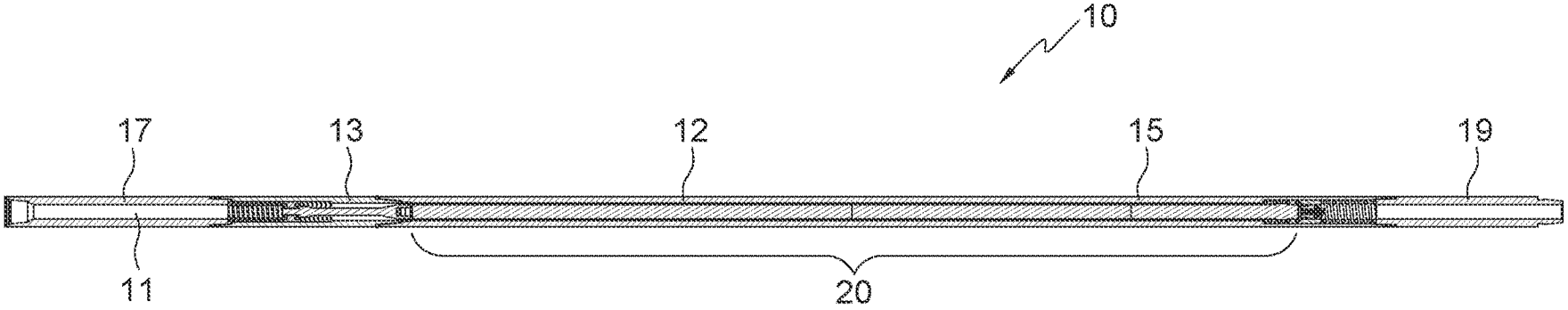
FIG. 1 is a cross section side view of the present apparatus, according to embodiments.

According to embodiments, the present apparatus and methods of use provide improved means for absorbing extreme downhole shock and vibration imparted by a drill string on a measurement-while-drilling (MWD) system positioned within the string, including a unified (e.g., single) or dual telemetry MWD system comprising both mud pulse 'MP' and electromagnetic 'EM' telemetry capabilities. Herein, unified (e.g., single) or dual telemetry MWD systems means those systems known in the art having either MP or EM telemetry capabilities alone, or MP and EM telemetry capabilities in combination.

As would be appreciated, intermittent transfer of weight to the drill bit due to friction during the drilling of a downhole wellbore creates axial vibrations and shock that can interfere with the transmission of signals generated by the MWD system and can cause equipment damage (e.g., downhole sensors). Drilling downhole wellbores over the recent years requires the use of Polycrystalline Diamond Compact (PDC) bits that cut the formation aggressively compared to previous roller cone bits, producing tangential friction and variable rotation of the drill string (e.g., sudden stop and start conditions or stick slip). Such conditions can impact the MWD system, which might need to remain constantly oriented in the collar as a result the MWD system and the orienting features (if present), can be damaged by the rotational forces of the drill string.

The present apparatus and methods of use comprise suspending the whole MWD system between at least two absorbing means within the drill string, the absorbing means separated by at least one annular ring and serving to isolate the MWD system from axial shock and vibration in both directions (upward and downward) without impacting either MP or EM MWD telemetry capabilities, i.e., while maintaining electrical contact of the EM signal and localizing the mud pulser signal. Advantageously, the present apparatus and methods of use ensure that the MWD system may be substantially isolated from axial, lateral, and torsional vibrations imparted on the system by the drill string.

In some embodiments, the present apparatus and methods of use may comprise at least one flow sleeve (orifice) operably connected to the MWD assembly. As will be described, in some embodiments, flow sleeve may be configured for to reciprocate with the MWD assembly (i.e., being axially translatable with the assembly), while in other embodiments flow sleeve may be fixedly connected within the drilling system. In either embodiment, the flow sleeve may be positioned at or near where the mud pulse valve of the MP system generates the mud pulse signal, such axial positioning of the valve and the flow sleeve being important in the quality of the generated signal. As may be appreciated, advantageously, where the MWD assembly and the flow sleeve are configured to move together axially with the dampening stroke (i.e., where flow sleeve reciprocates with the MWD assembly within the drilling system), the MP telemetry signal to the surface will not be affected. As will be described, given that the flow sleeve does not limit the stroke of the absorbing system, the presently described technology is capable of dampening significantly larger shock and vibration amplitudes.

In some embodiments, the present apparatus and methods of use may ensure that electrical contact is maintained through the absorbing means, enabling the shock/vibration isolation of a single or dual telemetry MWD system without disruption of electrical contact of the EM signal to the surface. The suspended nature of the design allows the MWD tools to be maintained between an upper and lower spring to absorb axial shock and vibration while keeping the electrical contact through these absorbing springs and at least one annular ring positioned therebetween. Positioning absorbing mechanisms at or near the MWD assembly, and in some cases above and below the MWD assembly (unlike known designs where the absorbing mechanism is only located on one side of the MWD tool) can allow for electrical gap isolation technology connections in between the absorbers, which is important for EM signal creation.

It should be appreciated that the presently described absorbing mechanisms may be positioned in any manner that operatively maintains an electrical gap isolation without departing from the present invention. Furthermore, enabling the presently configured absorbing mechanisms to provide a current pathway allows for the current to be fully transferred to operate the EM system without the damaging effects of smaller conductors getting degraded and limiting the current output. That is, both MP and EM signals can be transferred to the surface, while allowing for enough stroke to dampen larger shock and vibration amplitudes downhole.

In the present description, the terms "above/below" and "upper/lower" are used for ease of understanding and are generally intended to mean the relative uphole and downhole from surface. For example, without limitation and for explanatory purposes only, the present apparatus may be described with reference to an uphole end of the borehole or well shown to the left of the images, and the downhole end to the right.

In the present description, the present apparatus may be described as being incorporated into or operably connected with a drill string have a drill bit at its lower (downhole) end, the bit driven by surface rotation of the drillstring, or a mud motor powered by drilling equipment at the surface that pumps drill fluid or "mud" through the drill string. As would be appreciated in the art, the present apparatus may be used in combination with any measurement-while-drilling (MWD) system known in the art, and specifically with a single- or dual-telemetry MWD system operative to transmit data from downhole in a wellbore being drilled in an earth formation to a surface station.

The present improved apparatus and methodologies will now be described having regard to FIGS. 1-7.

According to embodiments, having regard to FIG. 1, a schematic representation of the presently improved apparatus 10 is shown, the apparatus 10 serving to dampen vibrations and/or shocks generated by a drill bit positioned at the downhole end of a drill string. Although vibrations and/or shocks are described herein as being caused by the drill bit, it should be readily understood that vibrations and/or shocks caused by any source are contemplated including, without limitation, jars, agitators, well contact, and the like.

According to embodiments, generally, apparatus 10 may be configured for incorporation into a drilling system, such as a rotary drilling system used for drilling wellbores into subterranean formations for the recovery of hydrocarbons in the oil and gas industry. The drilling system may comprise, inter alia, a drill string made up of multiple sections of drill pipe and include a mud motor and a drill bit at the bottom thereof (not shown). The drilling system may also include a series of drilling collars (used to stiffen the bottom of the string and add weight to assist the drilling process) and a measurement-while-drilling (MWD) tool assembly 20, the assembly generally positioned above the mud motor and drill bit. Drilling fluid or "mud" pumped from the surface flows through the drilling system, including through the MWD housing assembly, powering the mud motor to drive the drill bit. Mud then returns to the surface by traveling through the annular space between the outer diameter of the drilling system and the wellbore.

According to embodiments, generally, apparatus 10 may be configured for incorporation into a drilling system so as to be positioned at or near a measurement-while-drilling (MWD) assembly 20, and preferably a single- or dual-telemetry MWD assembly. MWD assembly 20 may be arranged conventionally with respect to a bottom hole assembly of the drilling system, and include sensors or transducers which, while drilling is in progress, continuously or intermittently monitor certain drilling parameters and formation data. Where MWD assembly 20 comprises a dual-telemetry system, it may include both a mud pulser 'MP' and electromagnetic 'EM' componentry (e.g., control electronics, natural gamma ray sensor, inclination and directional sensors, batteries, etc.).

MP telemetry involves creating pressure signals in the drilling mud that is being circulated under pressure through the drilling system. The pressure in the drilling mud is typically modulated via operation of a valve and control mechanisms, generally termed a pulser or mud-pulser. The generated pressure pulse travels up the mud column inside the drill string at the velocity of sound in the mud to a surface detector/receiver.

EM radiation telemetry involves inducing a current on the drilling system from a downhole transmitter and impressing an electrical potential across an insulated gap to generate a current that will propagate through the subterranean formation. The signal that propagates through the formation is then measured using a conductive stake that is driven into the ground at some distance from the drilling system, and the potential difference of the drill string signal and the formation signal can be measured.

Herein, it is an object of the present apparatus 10 to dampen shocks and vibrations imparted on the MWD assembly 20 by the drilling system.

According to embodiments, more specifically, apparatus 10 comprises a tubular housing 12 having a substantially cylindrical cross-section with a sidewall forming a central housing bore 11 extending therethrough, housing 12 being operably connected to the drill string. Central housing bore 11 of housing 12 may be sized and shaped so as to receive and house MWD assembly 20. Central housing bore 11 of housing 12 may also be sized and shaped so as to form a fluid channel for pressurized drilling fluids, such as drilling 'mud', and a conduit for pulses generated by a mud pulser within MWD assembly 20, as will be described.

According to embodiments, housing 12 of apparatus 10 may be configured for incorporating into a drill string. In some embodiments, housing 12 may comprise at least one tubular. In other embodiments, housing 12 may comprise more than one tubular, such more than one tubular configured for incorporating into a drill string. In such embodiments, a central bore each tubular are in fluid communication to form a fluid channel extending through apparatus 10.

Having further regard to FIG. 1, at its uphole end, housing 12 may comprise at least one upper tubular 13 and, at its downhole end, housing 12 may comprise at least one lower tubular 15. In some embodiments, upper and lower tubulars 13,15 may be operably connected to each other and to the drill string, such as via end-to-end threadable engagement, i.e., via a box-and-pin joint, or any other means for operable connection known in the art.

According to embodiments, housing 12 of apparatus 10 may be connected for incorporating into to the drill string via one or more cross-over tubulars or 'subs'. In some embodiments, at its uphole end, housing 12 may be operably connected to at least one uphole cross-over sub 17 and, at its downhole end, housing 12 may be operably connected to at least one downhole cross-over sub 19. In some embodiments, upper and lower housing tubulars 13,15 may each be configured for threadable connection (e.g., end-to-end via a box-and-pin joint connection) with one or more of the at least one cross-over subs 17,19, respectively. Cross-over subs 17, 19 may in turn be threadably connected with the drill string for running in hole therewith.

Advantageously, operatively connecting housing 12 to at least one cross-over sub 17,19, i.e., via upper and lower housing tubulars 13,15, respectively, enables gap technology to be used to form an electrical isolation in the drill string across which a current can be applied for an EM telemetry system. For example, as will be described, apparatus 10 may be designed to provide electrical isolation of upper and lower housing tubulars 13,15 using at least one inner and outer electrically isolating ring 18*a*,18*b*, respectively (see FIG. 2), and an electrically isolating or coating layer on its threaded mating ends 18*c*. As would be appreciated, apparatus 10 may be configured to provide at least two electrical gaps, such as those described herein within housing 18*a*-18*c*, as well as within MWD assembly 18*d*, such electrical gap isolating technology as described in U.S. Pat. No. 7,255,183 B2, incorporated entirely herein by reference.

Also advantageously, operatively configuring housing 12 to provide at least two tubulars 13,15 enables a portion of at least one tubular (e.g., upper tubular 13) to form a modified inner sidewall, such sidewall designed to comprise peripheral segments defining at least one planar surface for correspondingly interfacing with and preventing rotation of an outer surface of a flex rod received within central bore 11 of tubular 13. In some embodiments, the modified inner sidewall may comprise a polygonal cross-section, such as a pentagon, hexagon, or the like (see FIGS. 4A and 4B), as will be described.

As above, according to embodiments, housing 12 of apparatus 10 may be sized and shaped so as to receive at least one MWD assembly 20. In some embodiments, having regard to FIG. 2, MWD assembly 20 may comprise a single or dual telemetry MWD assembly 20 having both MP and EM componentry as would be known in the art. In some embodiments, MWD assembly 20 may comprise at least one flex rod 30 operably connected thereto.

According to embodiments, MWD assembly 20 may be suspended within central bore 11 of housing 12 by at least one primary shock and vibration-absorbing elements, i.e., a first movement dampening element. In such embodiments, the at least one first movement dampening element may be positioned above (uphole) or below (downhole) of MWD assembly 20.

According to other embodiments, MWD assembly 20 may be suspended within central bore 11 of housing 12 by at least two first shock and vibration-absorbing elements, i.e., at least two first movement dampening elements. In such embodiments, the at least two first movement dampening elements may both be positioned uphole of MWD assembly 20 or both positioned downhole of MWD assembly 20. In other such embodiments, the at least two first movement dampening elements may be positioned where at least one of the at least two first dampening elements is positioned uphole of MWD assembly 20 and at least one of the other at least two first dampening elements is positioned downhole of MWD assembly 20.

Figure 2:
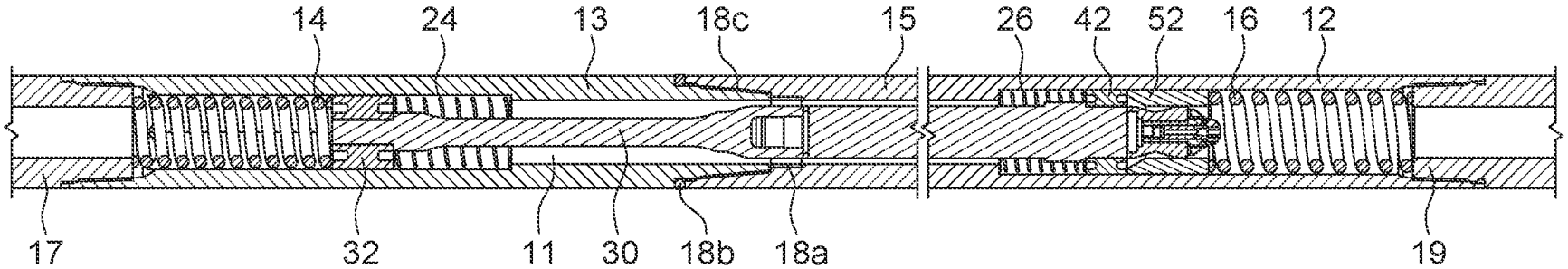
FIG. 2 is a zoomed in cross section side view of uphole and downhole ends of the apparatus shown in FIG. 1, according to embodiments.

For example, having regard to FIG. 2, at least one movement dampening element 14 may be positioned at or near an uphole end of MWD assembly 20, and at least one other movement dampening element 16 may be positioned at or near a downhole end of MWD assembly 20. Dampening element(s) 14,16 may comprise any suitable elements for dampening axial movement (e.g., uphole/downhole) imparted by a drill string on an MWD assembly 20 known in the industry including, without limitation, a helical spring. Although helical springs are described herein, such springs are described as an example only and any other suitable means for dampening shock and vibration imparted by a drill string on an MWD assembly 20 are contemplated (e.g., Belleville springs, or the like).

In some embodiments, dampening elements 14,16 may be held in place and in appropriate opposing compression contact with MWD assembly 20 by cross-over subs 17,19, respectively, enabling dampening elements 14,16 to absorb axial shock and vibrations imparted on assembly 20 from either above (uphole) and/or below (downhole). That is, MWD assembly 20 may be securely held in suspension between dampening elements 14,16, such that elements 14,16 serve to resist and absorb axial forces imposed upon the assembly 20 (i.e., with elements 14,16 being operably pre-loaded to compress and extend back to their original shape in response to such forces).

According to embodiments, optionally, MWD assembly 20 may be further suspended within central bore 11 of housing 12 by at least one additional or secondary shock and vibration-absorbing (movement dampening) element. In such embodiments, the at least one secondary movement dampening element may be positioned above (uphole) or below (downhole) of MWD assembly 20. The terms 'primary' and 'secondary' herein are used to distinguish between the at least one first movement dampening element and the at least one second, additional movement dampening element and is not intended to refer to a primary or secondary function of such elements.

According to other embodiments, MWD assembly 20 may be suspended within central bore 11 of housing 12 by at least two secondary shock and vibration-absorbing element(s), i.e., at least two additional (secondary) movement dampening elements. In such embodiments, the at least two second movement dampening elements may both be positioned uphole of MWD assembly 20 or both positioned downhole of MWD assembly 20. In other such embodiments, the at least two second movement dampening elements may be positioned where at least one of the at least two second dampening elements is positioned uphole of MWD assembly 20 and at least one of the other at least two dampening elements is positioned downhole of MWD assembly 20.

For example, having further regard to FIG. 2, a first at least one additional, second movement dampening element 24 may be positioned at or near the uphole end of MWD assembly 20, and between first dampening element 14 and assembly 20. Another at least one additional, second movement dampening element 26 may be positioned at or near the downhole end of MWD assembly 20, and between first dampening element 16 and assembly 20. First and second at least one additional movement dampening elements 24,26 may comprise any suitable elements for enhancing the dampening of movement (e.g., uphole/downhole) imparted by the drill string on an MWD assembly known in the industry, including, without limitation, helical springs. In some embodiments, additional dampening elements 24,26 may comprise substantially similar and/or different characteristics than first dampening elements 14,16 and may also serve as a redundant electrical contact. Although helical springs are described herein, such springs are described as an example only and any other suitable uphole and downhole means for dampening movement imparted by a drill string on an MWD assembly are contemplated (e.g., Belleville springs, or the like). Although specific positioning of dampening elements 14,16 and additional dampening elements 24,26 are described, such description is as an example only and any other suitable positioning of the elements 14,16 and 24,26 relative to each other and to MWD assembly 20 are contemplated.

In some embodiments, the at least two additionally dampening elements 24,26 may be held in place and in appropriate opposing compression contact with MWD assembly 20 at least one annular ring 32,42, respectively, enabling additional dampening elements 24,26 to absorb additional axial shock and vibrations imparted on assembly 20 from either above (uphole) and/or below (downhole). That is, MWD assembly 20 may be further held in suspension between dampening elements 24,26, such that elements 24,26 serve to resist and, in combination with dampening elements 14,16, absorb additional axial forces imposed upon the assembly 20 (i.e., with elements 24,26 being operably pre-loaded to compress and extend back to their original shape in response to such forces).

According to embodiments, as above, MWD assembly 20 may be operably connected to at least torsional shock or movement absorber for dampening torsional forces imposed upon the assembly 20, i.e., effectively decoupling assembly 20 from such forces. In some embodiments, torsional absorber may comprise a flex rod 30. Rod 30 may be operably connected to MWD assembly 20 so as to dampen bending/torsional shock and vibrations imposed upon assembly 20. For example, having regard to FIG. 3, rod 30 may comprise a solid rod having upper and lower ends 31,33, and a central portion of which that forms a substantially rounded thin cross section. In this manner, torsional or rotational forces imposed upon housing 12 that are transmitted through apparatus 10 can be absorbed by the bending/twisting of rod 30. Although torsional absorber is described herein as a flex rod, any other suitable means for absorbing torsional forces imposed upon the MWD assembly are contemplated including, without limitation, torsional springs.

Figure 3:
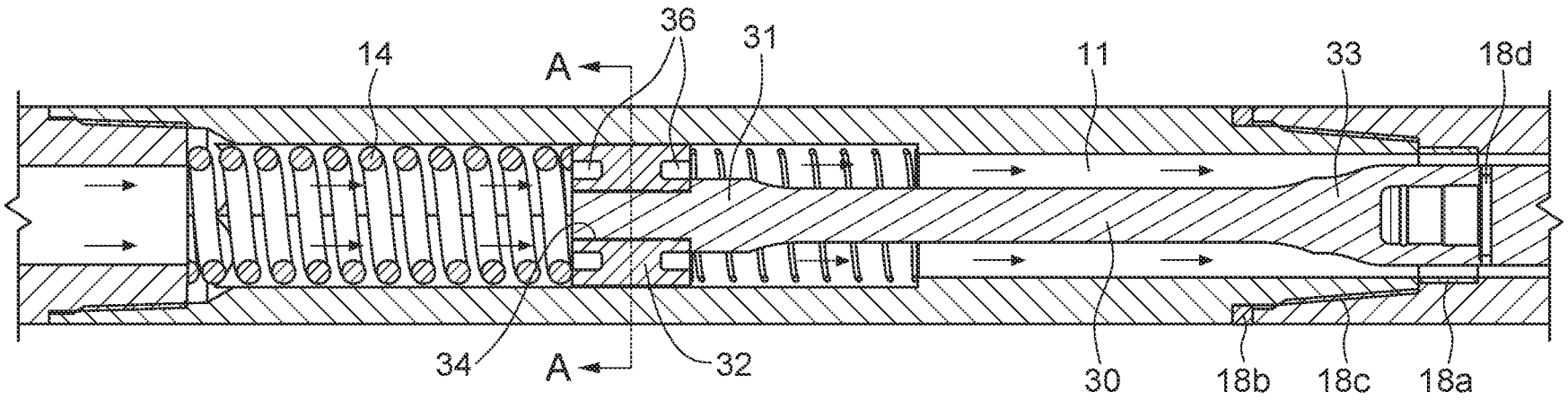
FIG. 3 is a further zoomed in cross section side view of an uphole end of the apparatus shown in FIG. 2, according to embodiments.

More specifically, in some embodiments and having further regard to FIG. 3, at its lower end 33, rod 30 may be operably connected to the uphole end of MWD assembly 20, the thinner central portion of rod 30 serving to bend and twist in response to, and for the dampening of, torsional forces imparted on MWD assembly 20. Rod 30 may minimize bending/torsional fatigue and reduce related bending/torsional failures. As above, although a 'flex rod' configuration of rod 30 is described herein, any suitable means for absorbing torsional oscillations imparted on an MWD assembly 20 by a drilling system, isolating the assembly 20 from the drilling system, are contemplated including, without limitation, a stiff, machined torsional spring (e.g., where a greater amount of torsional oscillation dampening is desired). In some embodiments, at its upper end 31, rod 30 may be slidingly received within and threadably engaged to at least one annular ring 32 (as will be described in more detail below).

According to embodiments, apparatus 10 may be configured for the uphole end of MWD assembly 20 and rod 30 to be securely isolated within central bore 11 of housing 12 and suspended between dampening elements 14,16 (and, when used, additional dampening elements 24,26). In some embodiments, apparatus 10 may comprise at least one mechanism for shouldering movement at or near the uphole end of MWD assembly 20. For example, apparatus 10 may be configured to receive and house at least one shouldering mechanism, or upper annular ring 32, as will be described in more detail.

In some embodiments, returning to FIG. 3, apparatus 10 may comprise at least one first annular ring 32, ring 32 positioned between MWD assembly 20 and at least one of first movement dampening elements 14. In this manner, ring 32 may be operably connected to and move axially within central bore 11 with both MWD assembly 20 and dampening element 14. As will be described, advantageously, such positioning can serve to maintain electrical contact of the EM signal along housing 12 of apparatus 10.

Upper annular ring 32 may form a central ring bore 34 extending therethrough, ring bore 34 being sized and shaped to receive and retain upper end 31 of rod 30. For example, central ring bore 34 may be configured for threaded engagement, or any other suitable means for fixing the alignment of ring 32 and rod 30. In this manner, in some embodiments, rod 30 (and MWD assembly 20 correspondingly engaged therewith) can shoulder through annular ring 32, preventing MWD assembly 20 from rotational movement relative to housing 12 (as described below) while still allowing guided or supported axial movement (uphole/downhole) within central bore 11 of housing 12. Upper annular ring 32 may also form at least one fluid channel 36 extending therethrough, fluid channels 36 allowing fluid communication (i.e., the flow of drilling mud) from surface through ring 32 to the central bore 11 (see fluid flow arrows, FIG. 3).

In some embodiments, annular ring 32 may have an uphole end, a downhole end, and a sidewall forming a substantially polygonal outer diameter. For example, having regard to FIG. 4A, the outer diameter of ring 32 may be sized and shaped to correspond with, and prevent rotation relative to, the substantially matching polygonal shaped profile of inner sidewall of housing tubular 13. In some embodiments, the interfacing profile may comprise a hexagonal shape, although any other suitable interface between ring 32 and housing 12 is contemplated. In this manner, the outer surface of annular ring 32 can engage with the inner sidewall of housing tubular 13 to lock the MWD assembly 20 rotationally relative to the housing 12 of apparatus 10.

Figure 4B:
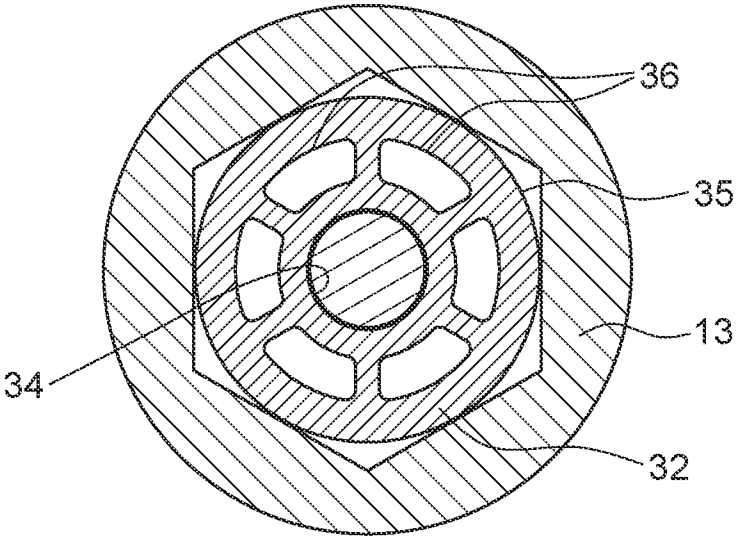
FIG. 4B is a cross section view of an alternative embodiment of the apparatus shown in FIG. 3, taken along lines A-A, according to embodiments.
Figure 4A:
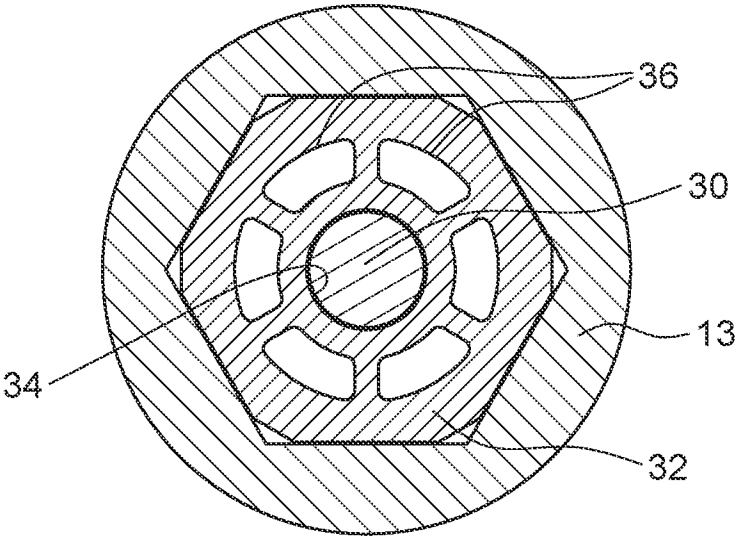
FIG. 4A is a cross section view of the apparatus shown in FIG. 3, taken along lines A-A, according to embodiments.

In some embodiments, at its upper end 31, rod 30 may be operably connected to annular ring 32, slidably received within upper tubular 13 (i.e., where sub serves as rod housing), and abutting dampening element 14. In this manner, ring 32 having a substantially polygonal shape (e.g., hexagonal) may be received inside rod housing 13 (and rotationally locked thereto), and upper end 31 of rod 30 may be received within rod bore 34 of ring 32 (and rotationally locked thereto; FIG. 4A).

Although a polygonal (e.g., hexagonal) lock-and-key profile configuration is described between ring 32 and housing 13, any suitable matching profile between ring 32 and housing 13 operative to prevent rotation of ring 32, rod 30, and by extension MWD assembly 20 is contemplated. In this manner, advantageously, MWD assembly 20 may be fixed rotationally to the drilling system through the rod and ring 30,32, restricting rotational movement of the MWD assembly 20 while still allowing for axial movement (and maintaining electrical contact through the at least two first dampening elements 14,16, as will be described) and torsional dampening through torsional absorber 30.

In alternative embodiments, annular ring 32 may have an uphole end, a downhole end, and a sidewall forming a substantially circular cross-section 35. For example, having regard to FIG. 4B, the outer diameter of ring 32 may be substantially circular to decouple MWD assembly 20 from housing 13 and allow rotation relative to the inner sidewall of housing tubular 13.

According to embodiments, apparatus 10 may be further configured for the downhole end of the MWD assembly 20 to be securely isolated within central bore 11 of housing 12 and suspended between dampening elements 14,16 (and, when used, additional dampening elements 24,26). In some embodiments, apparatus 10 may comprise at least one further mechanism for shouldering movement at or near the downhole end of the MWD assembly 20. For example, apparatus 10 may be configured to receive and house at least one second shouldering mechanism, or lower annular ring 42, as will be described in more detail.

Figure 5:
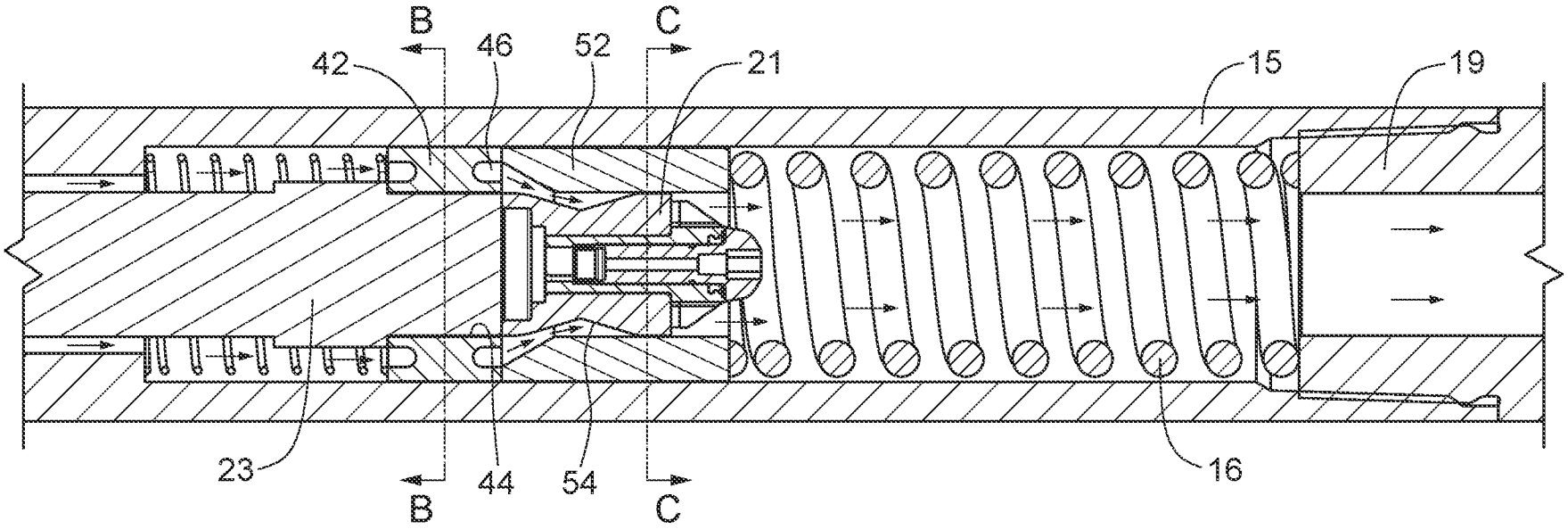
FIG. 5 is a further zoomed in cross section side view of a downhole end of the apparatus shown in FIG. 2, according to embodiments.
Figure 6:
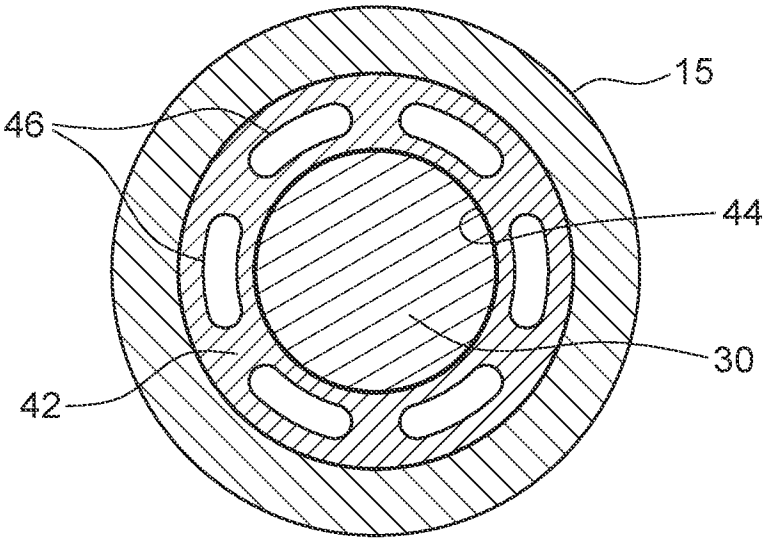
FIG. 6 is a cross section view of the apparatus shown in FIG. 5, taken along lines B-B, according to embodiments.

In some embodiments, having regard to FIG. 5, apparatus 10 may comprise at least one second annular ring 42, ring 42 positioned at or near the lower end of the MWD assembly 20 and substantially adjacent at least one second dampening element 16. In this manner, lower ring 42 may be operably connected to and move axially within central bore 11 with both the MWD assembly 20 and the dampening element 16. Lower annular ring 42 may form a central bore 44 extending therethrough, ring bore 44 being sized and shaped to receive and retain lower end 23 of MWD assembly 20 (see FIG. 6). In this manner, at least a portion of the downhole end of the MWD assembly shoulders through annular lower ring 42, allowing guided or supported axial movement (uphole/downhole) within central bore 11 of housing 12. Lower annular ring 42 may also form at least one fluid channel 46 extending therethrough, fluid channels 46 allowing communication (i.e., the flow of drilling mud) from surface through lower ring 42 to the central bore 11 downbelow (see fluid flow arrows, FIGS. 3 and 5).

According to embodiments, apparatus 10 may be further configured for the downhole end of MWD assembly 20 and rod 30 to be securely isolated within central bore 11 of housing 12 and suspended between dampening elements 14,16 (and, when used, additional dampening elements 24,26). In some embodiments, apparatus 10 may comprise at least one mechanism for further shouldering movement at or near the downhole end MWD assembly 20, without impacting signals generated by the assembly 20. For example, apparatus 10 may be further configured to receive and house at least one further shouldering mechanism, or flow sleeve 52, as will be described in more detail.

In some embodiments, having regard to FIG. 5, apparatus may comprise at least one annular flow sleeve 52 positioned between at or near the lower end of the MWD assembly 20 for slidably receiving and localizing the mud pulser 21 componentry of assembly 20. In some embodiments, flow sleeve 52 may fixedly connected to housing 12 of apparatus 10. In other embodiments, flow sleeve 52 may be operably connected to and move axially with MWD assembly 20 within central bore 11 (e.g., along with lower annular ring 42, and dampening element 16).

In some embodiments, flow sleeve 52 may form a central sleeve bore 54 (see FIG. 7) extending therethrough, sleeve bore 54 being sized and shaped to receive and localize the mud-pulse or valve componentry 21 of MWD assembly 20 and serving to enhance fluid flow control (e.g., choke) through valve 21. In this manner, apparatus 10 serves to receive and dissociate assembly 20 from the drilling system (and thus axial, torsional shock and vibration), while allowing uninhibited, guided and supported, axial movement (uphole/downhole) of assembly 20 within central bore 11 of housing 12, and while maintaining the mud pulse signal (i.e., without affecting the MP telemetry signal quality).

Figure 7:
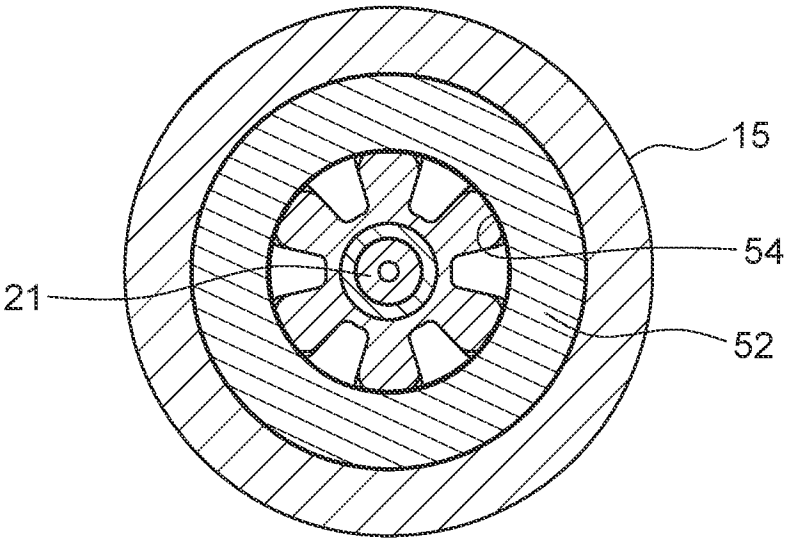
FIG. 7 is a cross section view of the apparatus shown in FIG. 5, taken along lines C-C, according to embodiments.

In some embodiments, sleeve bore 54 may form a fluid channel extending therethrough, fluid channel allowing fluid communication (i.e., the flow of drilling mud) from surface through sleeve 52 to the MP componentry (e.g., mud-pulser or fluid flow restriction valve shown in an open position 21) housed therewithin (see FIG. 7). Advantageously, securing the MP componentry within axially translatable flow sleeve 52 enables the present apparatus 10 to achieve an MP signal without being impacted by absorbing elements and strokes, enabling larger strokes to be dampened by dampening elements 14,16 and/or 24,26 without signal loss.

According to embodiments, having regard to FIG. 7, the restricted fluid flow through the MP componentry (e.g., mud-pulser or valve 21), when the componentry is in a closed position, can provide additional axial dampening of the MWD assembly 20 besides the absorbing provided by correspondingly opposed dampening elements 14,16 and 24,26. In alternative embodiments, additional fluid flow bypass channels may be incorporated into flow sleeve 52, communicating fluid pressure above and below the MP componentry to reduce or modify its dampening effect over the MWD assembly 20.

According to embodiments, as above, dampening elements 14,16 may further serve to provide and maintain an electrical contact between MWD assembly 20 and housing 12 (i.e., via upper and lower tubulars 13,15, referenced in FIG. 2), thereby creating an EM signal, and allowing a current to be transmitted to surface. For example, dampening elements 14,16 enables electrical contact along apparatus 10 to occur at a larger surface of the absorbing elements 14,16, providing improved and more consistent electrical contact. Moreover, positioning of dampening elements 14,16 above and below MWD assembly 20 advantageously can allow for an electrical gap connection to be placed or formed therebetween. More specifically, upper and lower tubulars 13,15 may be isolated using inner and outer ceramic rings 18*a*,18*b* threadably engaged and isolated therebetween (see FIG. 2). Given that MWD assembly 20 also comprises inner gap technology isolating its upper and lower ends via contact with upper and lower subs 13,15 through dampening elements 14,16, the electrical circuit is complete, and an EM signal can be generated and transmitted directly to the surface. In this manner, it should be understood that dampening elements 14,16 not only serve to absorb axial vibrations caused by the drill string, but they also provide electrical contact points for an EM signal. Moreover, in some embodiments, returning to FIG. 2, additional dampening elements 24,26 may comprise different similar and/or different characteristics to supplement the absorbing mechanism along dampening elements 14,16, and may also serve as a redundant electrical contact.

According to embodiments, apparatus 10 may be positioned generally above the mud-powered drilling motor within the drill string. In other embodiments, apparatus 10 may be positioned generally below the downhole mud-powered drilling motor within the drill string, i.e., where requirement of the high side (orientation locking) of the MWD assembly 20 may not be critical. In such alternative embodiments, both upper and lower annular rings 32,42 may each have an outer diameter forming substantially circular (or non-polygonal) profile configuration. In this manner, the MWD assembly 20 may be entirely rotationally decoupled from housing 12 and from any torsional oscillations, while dampening elements 14,16 may still continue to absorb axial vibrations. Advantageously, such alternative embodiments of the present apparatus 10 and methods of use provides for the MWD assembly 20 to be fully dissociated from the drill string (and thus torsional shock and vibration), while still absorbing axial vibrations without interruption of either the MP or EM signals to the surface.

Herein, it is contemplated that any heat generated by the present apparatus 10 and methods of use may dissipate through the circulation of drilling fluids (e.g., drilling mud), increasing the longevity of the apparatus 10. For example, where energy from shock and vibration absorbed by dampening elements 14,16 generates heat that needs to be dissipated for smooth performance of the apparatus 10, ongoing fluid flow may serve as a coolant and lubricant, reducing the heat generated by shock and vibration energy and lubricating the apparatus 10. As such, the present apparatus 10 and methods of use can eliminate the sealing and lubrication requirements of existing shock/vibration absorbing systems, thereby minimizing reliability concerns of the apparatus 10, particularly over longer drilling processes where the wear life of the apparatus 10 might decrease and the dual telemetry MWD system is at a higher risk of efficiency issues.

According to embodiments, methods of using the present apparatus 10 are also provided herein, such methods operable to dampen shock and vibration movement imparted by a drilling system on a dual telemetry MWD assembly 20 incorporated into the drilling system. The present methods may comprise providing apparatus 10 configured for incorporation into the drilling system (as is described in more detail below), incorporating apparatus 10 into the drilling system, and running the drilling system into a subterranean formation to drill a wellbore.

In such embodiments, apparatus 10 may be operative to house the MWD assembly 20 in suspension within the drilling system and may be further configured for suspending the MWD assembly 20 between at least two movement dampening elements 14,16, movement dampening elements 14,16 operative to dampen shock and vibration imparted axially on MWD assembly 20. Apparatus 10 may also be configured to reciprocate axially with MWD assembly 20, such configurations providing at least two annular rings 32,42 wherein at least one of the annular rings 42 is configured to prevent rotation of MWD assembly 20 relative to apparatus 10 and the drilling system. Additionally, apparatus 10 may be configured for dissociating MWD assembly 20 from the drilling system (i.e., decoupling movement of the assembly 20 from movements of the drilling system, such movements of the drilling system corresponding with shocks and vibrations that may interfere with operation of MWD assembly 20 telemetry if such shocks and vibrations are imparted on MWD assembly 20).

More particularly, in some embodiments, incorporating apparatus 10 into the drilling string may comprise threadably engaging apparatus 10 within a drill string of the drilling system, to be run inhole therewith. Apparatus may be threadably engaged with the drill string directly or via threadably engaging one or more cross-over subs 17,19 that are, in turn, threadably engaged within the drill string. Other known methods of incorporating apparatus 10 into the drilling string are known and contemplated herein.

Furthermore, in some embodiments, running the drilling system into a subterranean formation to drill a wellbore may comprise operating a drill bit of the drilling system, either powered by a mud motor located uphole of the drill bit or other known means, to drill out the wellbore into the subterranean formation. The drilling system, including apparatus 10, may be lowered into the wellbore as it is drilled out, using known methods. The term "lower" is not intended to be limiting and is contemplated to refer to known methods of causing a drilling system to drill out and descend into a vertical wellbore or move through a horizontal wellbore, including "jarring" and other operations in which the drilling system may be lowered and raised in sequential steps. As will be appreciated, both drilling out and lowering of the drilling system may cause shocks and vibrations that the present method is operable to dampen.

In some embodiments, the present methods may further comprise operably connecting MWD assembly 20 to at least one means for absorbing torsional forces imparted on assembly 20. Torsional absorber may comprise a flex rod 30 for dampening torsional shock and vibration movement of assembly 20, or any other suitable means known in the art including, without limitation, one or more torsional springs. For example, MWD assembly 20 may be threadably engaged with the flex rod 30, connected by assembling a box-and-pin joint mechanism, welded, or connected by any other known means, including where rod 30 may be integral to MWD assembly 20 (i.e., by manufacturing MWD assembly 20 and flex shaft 30 from a contiguous material, by a known molding/pouring process, by additive manufacturing, etc.).

In some embodiments, the present methods may further comprise providing at least one additional dampening element 24,26 for enhancing dampening of axial shock and vibration movement of assembly 20. In such embodiments, the at least one additional dampening elements 24,26 may be provided as part of apparatus 10, wherein the additional correspondingly opposed dampening elements 24,26 may be positioned proximate to the at least two movement dampening elements 14,16 and are operative to provide similar, additional, or different suspension characteristics to MWD assembly 20 compared thereto (thereby synergistically enhancing dampening of axial shock and vibration movement imparted on assembly 20).

In some embodiments, the present methods may further comprise providing means for locking rotational movement of assembly 20 relative to the drilling system.

In some embodiments, the present methods may further comprise operating MWD system 20 to transmit both MP and EM telemetry information from the formation using telemetry processes known in the art.

In some embodiments, the present methods may comprise incorporating apparatus 10 into the drilling system at or near the mud motor operative to drive the drill bit of the drill string. For example, apparatus 10 may be threadably engaged between an uphole drill string tubular and a downhole drill string tubular, wherein the uphole drill string tubular comprises or is adjacent to the mud motor and the downhole drill string tubular comprises or is adjacent to the drill bit. In some embodiments, apparatus 10 may be incorporated uphole of both the mud motor and drill bit. In other embodiments, apparatus 10 may be incorporated downhole of the mud motor and uphole of the drill bit. Optimal positioning of apparatus 10 relative to the mud motor and drill bit will be readily appreciated, based on the drilling requirements imposed by the subterranean wellbore and/or equipment used.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

We claim:

1. An apparatus configured for incorporation into a drilling system, the drilling system having a dual telemetry measurement-while-drilling (MWD) assembly, the apparatus for dampening shock and vibration movement imparted on the MWD assembly by the drilling system, comprising:

a tubular housing forming a central housing bore, the central bore for housing a dual telemetry MWD assembly, at least one first movement dampening element positioned at or near the MWD assembly for dampening shock and vibration movement imparted axially on the MWD assembly, at least one annular ring positioned between the at least one movement dampening element and the MWD assembly for securely receiving, and reciprocating axially with, the MWD assembly, an outer surface of the at least one annular ring comprises a substantially circular cross-section for decoupling the MWD assembly from the inner surface of the tubular housing, while maintaining electrical connectivity therebetween for transmission of an EM signal, and at least one flow sleeve for slidably receiving and localizing the mud pulser for generating a mud pulse signal.

2. The apparatus of claim 1, wherein the apparatus comprises at least two first movement dampening elements and the at least one annular ring is positioned therebetween.

3. The apparatus of claim 2, wherein one of the at least two first movement dampening elements is positioned uphole of the MWD assembly and another one of the at least two movement dampening elements is positioned downhole of the MWD assembly.

4. The apparatus of claim 1, wherein the at least one first movement dampening element comprises a spring.

5. The apparatus of claim 1, wherein the apparatus further comprises at least one secondary movement dampening element.

6. The apparatus of claim 1, wherein the apparatus further comprises at least one torsional absorber operably connected to the MWD assembly.

7. The apparatus of claim 6, wherein the torsional absorber comprises a flex rod threadably engaged to the at least one annular ring.

8. The apparatus of claim 1, wherein the outer surface of one of the at least one annular ring comprises a profile for correspondingly interfacing to and rotationally locking the MWD assembly with an inner surface of the tubular housing.

9. The apparatus of claim 8, wherein the profile comprises a substantially polygonal cross-section.

10. The apparatus of claim 1, wherein the tubular housing comprises at least two tubulars.

11. The apparatus of claim 10, wherein the at least two tubulars are operably connected to form at one electrical gap connection.

12. A method of dampening shock and vibration movement imparted by a drilling system on a dual telemetry MWD assembly incorporated into the drilling system, the drilling system used to drill a wellbore in a subterranean formation, the method comprising:

providing an apparatus configured for incorporation into the drilling system, the apparatus forming a tubular housing for receiving the MWD assembly, the apparatus configured for suspending the MWD assembly within the housing by at least one movement dampening element for dampening shock and vibration movement imparted axially on the MWD assembly, the MWD assembly being rotationally decoupled from the tubular housing by at least one annular ring for securely receiving, and reciprocating axially with, the MWD, the at least one annular ring being positioned between the at least one movement dampening element and the MWD assembly and having an outer surface comprising a substantially circular cross-section, enabling transmission of a mud pulse signal and maintaining electrical connectivity for transmission of an EM signal, and running the apparatus into the subterranean formation with the drilling system to drill the wellbore.

13. The method of claim 12, wherein the method further comprises providing at least one torsional absorber for dampening shock and vibration movement imparted torsionally on the MWD assembly.

14. The method of claim 12, wherein the method further comprises providing at least one secondary dampening element for enhancing dampening of axial shock and vibration movement.

15. The method of claim 12, wherein the method further comprises providing a rotation lock for preventing or limiting rotation of the MWD assembly relative to the drilling system.

16. The method of claim 12, wherein the method further comprises rotationally decoupling the MWD assembly from the drill string while providing axial isolation.

17. The method of claim 12, wherein the method further comprises operating the MWD assembly to transmit both mud-pulse (MP) and electromagnetic (EM) telemetry information from the formation.

18. The method of claim 12, wherein the method comprises providing an electrical gap connection.

19. The apparatus of claim 18, wherein the electrical gap connection is formed in the MWD assembly and in the tubular housing.

* * * * *